US009948020B1

(12) United States Patent
Lin

(10) Patent No.: US 9,948,020 B1
(45) Date of Patent: Apr. 17, 2018

(54) LID-EQUIPPED POWER SOCKET STRUCTURE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 15/647,910

(22) Filed: Jul. 12, 2017

(51) Int. Cl.
*H01R 13/44* (2006.01)
*H01R 13/447* (2006.01)
*H01R 13/52* (2006.01)
*H01R 13/508* (2006.01)

(52) U.S. Cl.
CPC ..... *H01R 13/447* (2013.01); *H01R 13/508* (2013.01); *H01R 13/5213* (2013.01)

(58) Field of Classification Search
CPC . H01R 13/5213; H01R 13/508; H01R 13/447
USPC ..... 439/136, 142, 143, 134, 148, 149; 174/53, 66, 67
See application file for complete search history.

(56) References Cited

U.S. PATENT DOCUMENTS 4,723,823 A * 2/1988 Pinkerton ..... H01R 13/447 439/136
5,108,297 A * 4/1992 Hoffman ..... H01R 13/447 439/134
5,145,393 A * 9/1992 Schoon ..... H01R 13/20 439/148
5,252,082 A * 10/1993 Hsieh ..... H01R 13/4538 439/136
5,545,046 A * 8/1996 Masuda ..... B60K 1/04 439/142
5,571,023 A * 11/1996 Anthony ..... H02G 3/14 220/242
5,624,270 A * 4/1997 Blanchot ..... H01R 13/4534 439/136
5,695,350 A * 12/1997 Mei ..... H01R 13/4532 439/139
5,774,980 A * 7/1998 Klein ..... H01R 13/5825 29/857
6,171,118 B1 * 1/2001 Witkowski ..... H01R 13/447 439/142
6,971,883 B1 * 12/2005 Ridge ..... H01R 13/516 439/142
7,005,591 B1 * 2/2006 Fleury ..... H01R 13/5213 200/51 R
7,220,137 B1 * 5/2007 Liu ..... H01R 13/447 220/375
9,243,436 B2 * 1/2016 Sawada ..... H01R 13/506
(Continued)

*Primary Examiner* — Abdullah Riyami
*Assistant Examiner* — Nelson R Burgos-Guntin
(74) *Attorney, Agent, or Firm* — WPAT, PC

(57) ABSTRACT

A lid-equipped power socket structure comprises at least one or more electric power sockets and an electric power plug, wherein the electric power plug is electrically connected to the electric power sockets through a set of power line materials, and the electric power socket comprises a socket body, a lid body internally having a gasket, and an external cladding shell, in which the external cladding shell can be sleeve installed onto the outer surface of the socket body; in addition, the external cladding shell may be pivotally connected to the lid body via a torsion spring such that the lid body can be lifted up or placed down onto the surface of the socket body, in which, when the lid body covers on the surface of the socket body, the gasket of the lid body can abut against the 3-holed socket on the surface of the electric power socket thereby achieving the objective of waterproof.

7 Claims, 7 Drawing Sheets

(56) References Cited

U.S. PATENT DOCUMENTS

| | | | | |
|---|---|---|---|---|
| 9,831,624 | B2 * | 11/2017 | Garvey | H01R 31/06 |
| 2005/0109529 | A1 * | 5/2005 | Nagashima | H02G 3/14<br>174/67 |
| 2012/0045921 | A1 * | 2/2012 | Lo | H01R 13/635<br>439/372 |
| 2012/0238121 | A1 * | 9/2012 | Kurumizawa | B60L 11/14<br>439/299 |
| 2015/0037989 | A1 * | 2/2015 | Byrne | H01R 13/4534<br>439/137 |

* cited by examiner

LID-EQUIPPED POWER SOCKET STRUCTURE

BACKGROUND OF THE INVENTION

1. Field of the Invention

The present invention generally relates to a lid-equipped power socket structure; in particular, it relates a lid-equipped power socket structure enabling the water-proof feature.

2. Description of Related Art

At present, it is very common to install a plurality of electric power sockets on the indoor walls; however, since the number of such electric power sockets may be limited and their installation positions may not meet the user's demands, the user may typically purchase and set up an additional extension power line to attach thereto thereby extending the available distance of the electric power sockets and increasing the number of available electric power sockets with extra electric power sockets configured on the extension power line in order to provide electric power to more electronic devices through plug insertions.

Because the overall areas and sizes of this type of extension power lines having multiple sockets are generally quite significant, some displacement issues and inconvenience may inevitably occur. Moreover, in using these extension power lines outdoors, since the plug holes thereof may be exposed to outdoor environments, it is possible that water may unknowingly flow or infiltrate into these openings in rainy days or during certain imprudent usage, which may seriously lead to electric power leakage problems. Hence, a kind of protective structure is desirably required for this sort of extension power lines in case of outdoor utilizations.

Therefore, in order to address the aforementioned issues, it would be an optimal solution if it is possible to completely cover the plug holes on the socket portions by means of a liftable lid body so as to prevent the plug holes from contacting conductive liquid thus reducing the possibility of electric power leakage or shock problems due to water.

SUMMARY OF THE INVENTION

A lid-equipped power socket structure capable of achieving the above-said objectives is disclosed, comprising: at least one or more electric power sockets, wherein the electric power socket includes: a socket body, having three plug holes thereon; a lid body, including a top lid part, in which an outer frame flange extends upwards from the perimeter of the top lid part, and a closed lid space can be formed between the top lid part and the outer frame flange, and the interior of the top lid part protrudes towards the closed lid space and is installed with a gasket thereon, which extends from an end of the outer frame flange to form a connecting part; an external cladding shell, capable of being sleeve installed onto the external surface of the socket body, in which the external cladding shell is a hollow accommodating shell, with an end of the hollow accommodating shell including a flexible convergent opening so that the hollow accommodating shell can be sleeve installed onto the external surface of the socket body and then further sleeve tied onto the socket body by means of the flexible convergent opening; meanwhile, the other end of the hollow accommodating shell includes an outwardly protrusive flange abutting part, and a lug part conjunctively having a torsion spring and a pivotal axle is installed in the proximity of the flange abutting part, in which the connecting part of the lid body is pivotally connected to the lug part via the torsion spring and the pivotal axle such that the outer frame flange of the lid body can cover the flange abutting part and the gasket within the closed lid space can abut against the plug holes of the socket body; and an electric power plug, electrically connected to the electric power socket through a set of power line materials.

More specifically, a flange is configured on the upper side of the aforementioned socket body.

More specifically, the aforementioned set of power line materials includes a first power line material, and an end of the first power line material is electrically connected to the electric power socket while the other end of the first power line material is electrically connected to the electric power plug, such that electric power coming from the electric power plug can be provided to the electric power socket.

More specifically, the aforementioned set of power line materials includes a first power line material as well as several extension power line materials extending from the first power line material, in which an end of the first power line material is electrically connected to the electric power plug and an end of the at least one extension power line material is electrically connected to at least one electric power socket, while the other end of the at least one extension power line material is electrically connected to at least one electronic device, such that electric power coming from the electric power plug can be shunted to the at least one electric power socket and at least one electronic device.

More specifically, the aforementioned electronic device may be a lamp.

More specifically, a liftable plate may further extend from the other end of the outer frame flange in the aforementioned lid body, with the liftable plate and top lid part being mutually tilted at a certain angle.

More specifically, the inside of the top lid part in the aforementioned lid body includes an inner frame part, with the gasket being combined within the inner frame part.

DETAILED DESCRIPTION OF THE PREFERRED EMBODIMENTS

Figure 1:
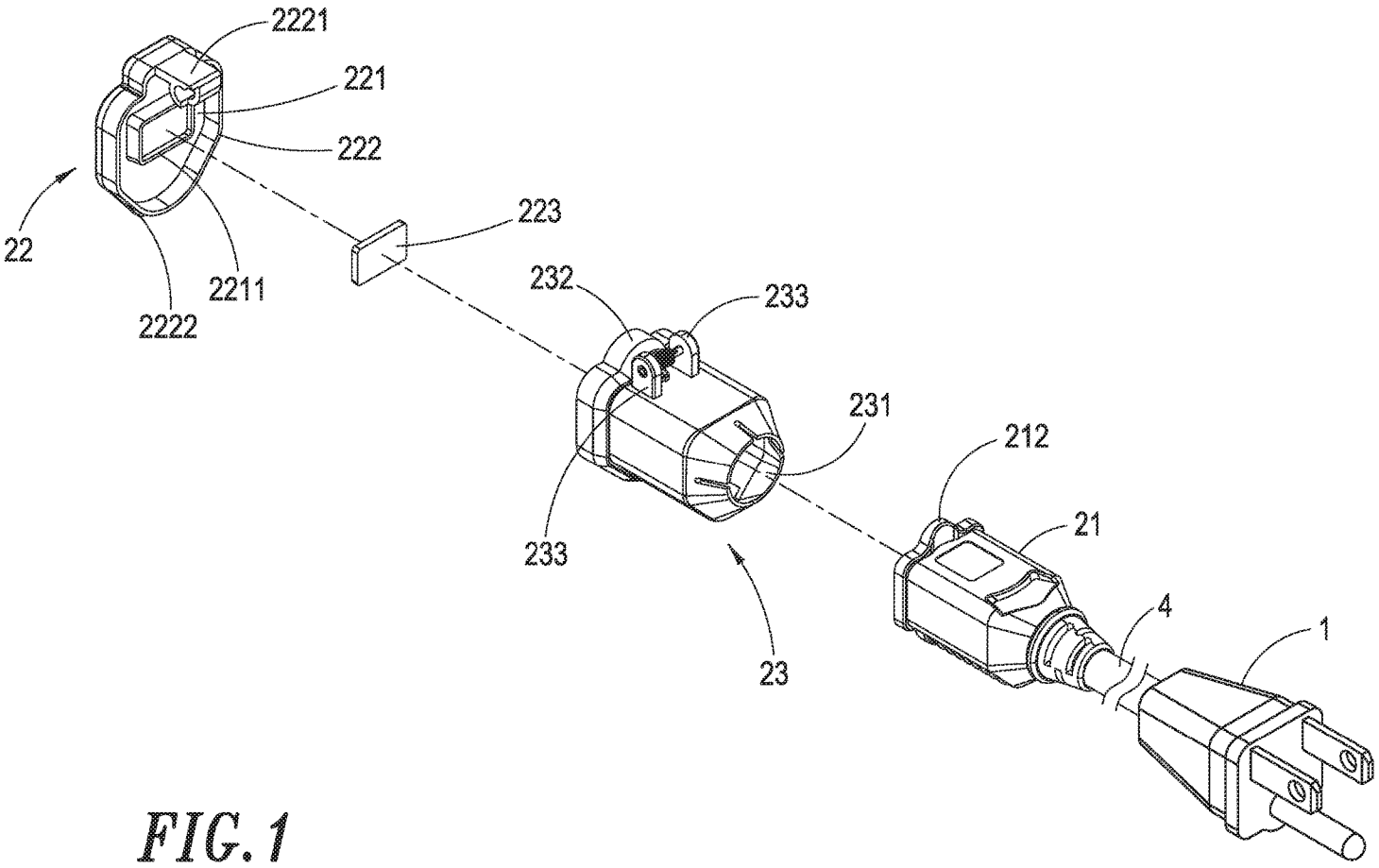
FIG. 1 shows a disassembled structural view of the lid-equipped power socket structure according to the present invention.
Figure 2:
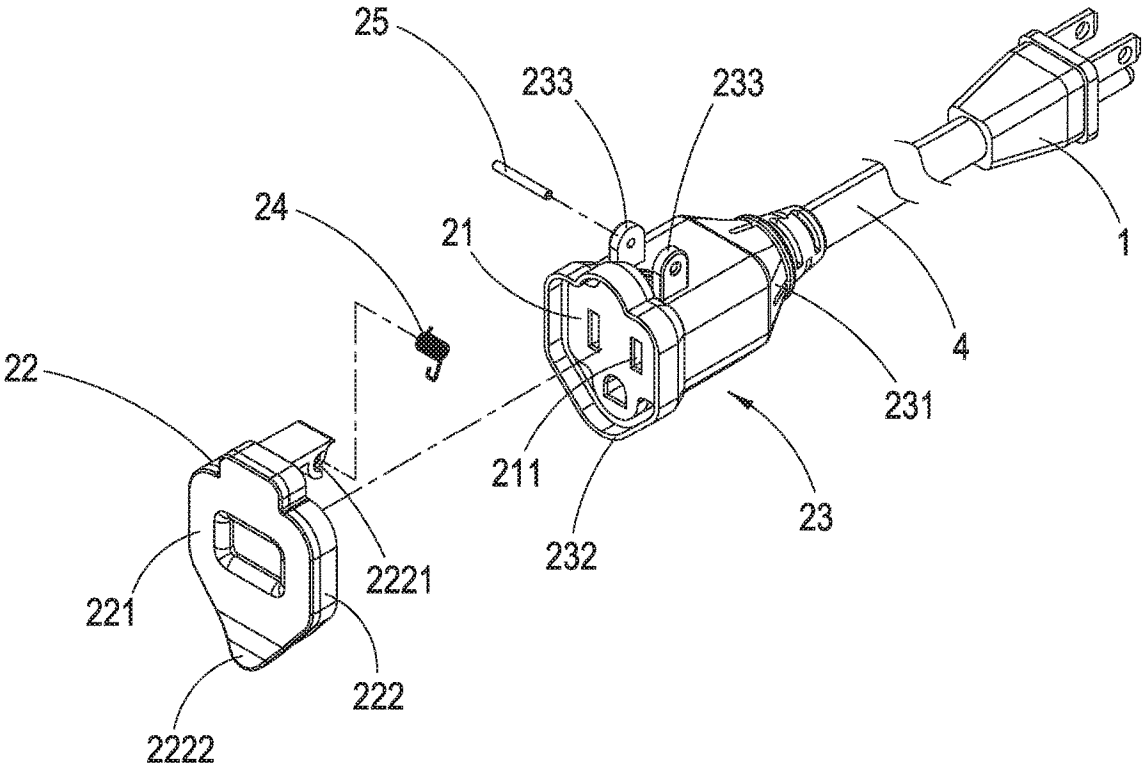
FIG. 2 shows a disassembled structural view of the lid-equipped power socket structure according to the present invention.
Figure 3:
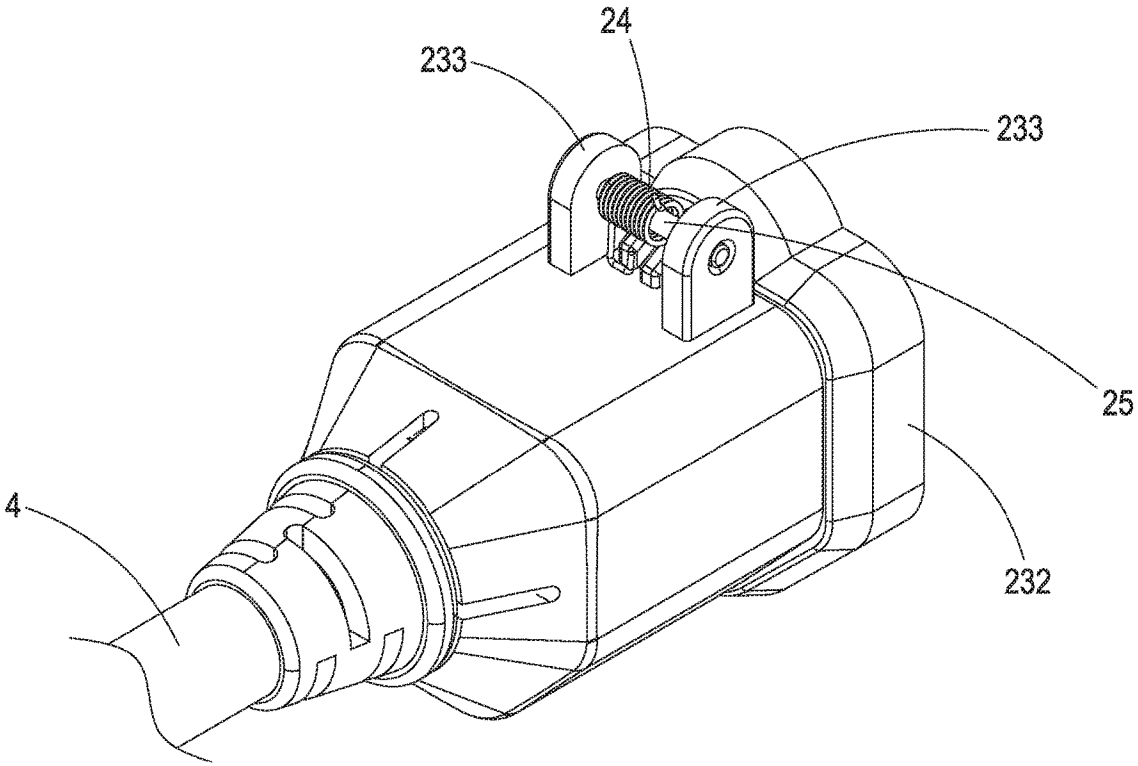
FIG. 3 shows a partial structural assembly view of the lid-equipped power socket structure according to the present invention.
Figure 4:
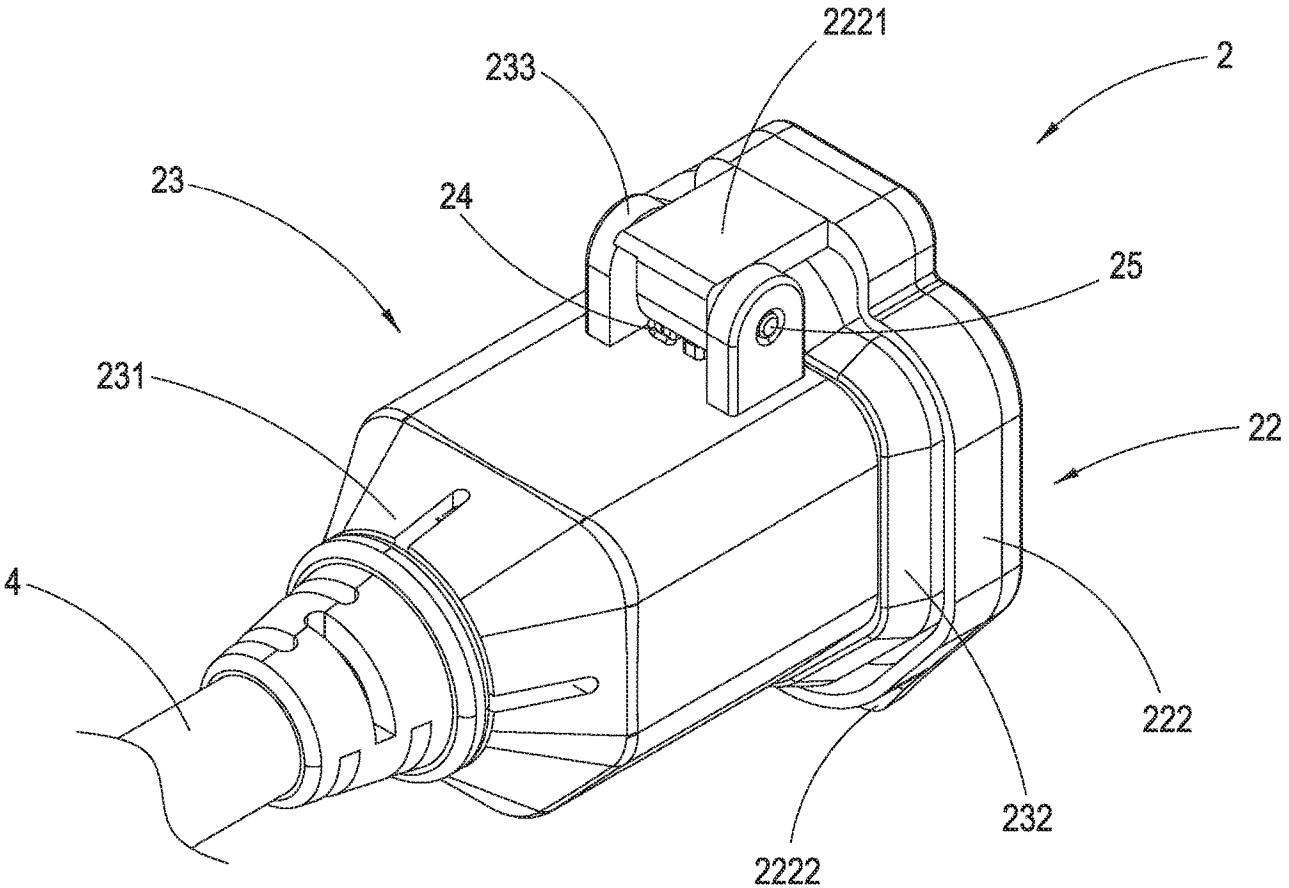
FIG. 4 shows a structural view of the lid-equipped power socket structure in combination with an electric power socket, according to the present invention.

Other technical contents, aspects and effects in relation to the present invention can be clearly appreciated through the detailed descriptions concerning the preferred embodiments of the present invention in conjunction with the appended drawings.

Refer initially to FIGS. 1-5, wherein a disassembled structural view, a partial structural assembly view, a structural view in combination with an electric power socket as well as a structural view in integral combination for the lid-equipped power socket structure according to the present invention are respectively shown. It can be appreciated from these drawings that the illustrated lid-equipped power socket structure comprises one or more electric power sockets 2 and an electric power plug 1, wherein the electric power plug 1 is electrically connected to the electric power sockets 2 through a set of power line materials.

In addition, the electric power socket 2 includes a socket body 21, a lid body 22 and an external cladding shell 23, wherein there are three plug holes 211 configured on the socket body 21, and a flange 212 is also installed on the upper side of the socket body 21 and applied to restrict and prevent from erroneously inserting the plug of 220 Volts voltage in a wrong direction by users in order to avoid potential circuit damages or other catastrophic consequences.

Also, the lid body 22 has a top lid part 221 and an outer frame flange 222 extends upwards from the perimeter of the top lid part 221, in which a closed lid space can be formed between the top lid part 221 and the outer frame flange 222, and the interior of the top lid part 221 includes an inner frame part 2211, while a gasket 223 can be combined within the inner frame part 2211 and protrudes towards the closed lid space from the top lid part 221; in addition, a connecting part 2221 extends from an end of the outer frame flange 222. Besides, a liftable plate 2222 may further extend from the other end of the outer frame flange 222 and be tilted with respect to the top lid part 221 at a certain angle.

Furthermore, an external cladding shell 23 may be sleeve installed onto the external surface of the socket body 21, in which the external cladding shell 23 is a hollow accommodating shell, with an end of the hollow accommodating shell including a flexible convergent opening 231 so that the hollow accommodating shell can be sleeve installed onto the external surface of the socket body 21 and then further sleeve tied onto the socket body 21 by means of the flexible convergent opening 231; meanwhile, the other end of the hollow accommodating shell includes a flange abutting part 232, and a lug part 233 conjunctively having a torsion spring 24 and a pivotal axle 25 is installed in the proximity of the flange abutting part 232, in which the connecting part 2221 of the lid body 22 is pivotally connected to the lug part 233 via the torsion spring 24 and the pivotal axle 25 such that the outer frame flange 222 of the lid body 22 can cover the flange abutting part 232 and the gasket 223 within the closed lid space can abut against the plug holes 211 of the socket body 21.

Figure 6:
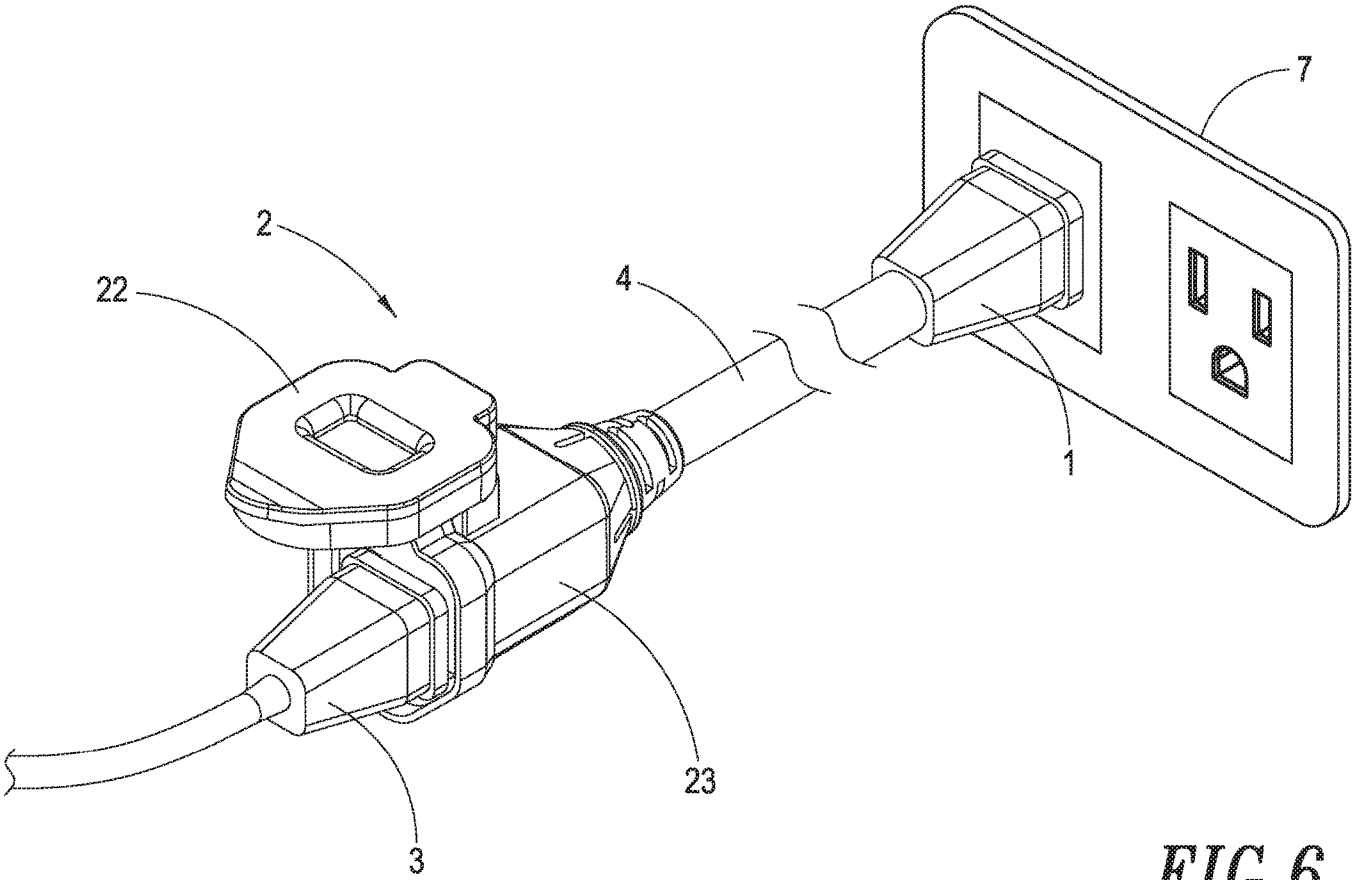
FIG. 6 shows an implementation structural view of the lid-equipped power socket structure according to the present invention.

As shown in FIG. 6, to supply electric power, it is possible to insert the electric power plug 1 into the power supply plug holes 7, and then insert the plug 3 of an electronic device into the triple plug holes 211 on the socket body 21; when power supply is no longer needed, it is also possible to pull the plug 3 of the electronic device off the plug holes 211, and, because of the torsion spring 24, the lid body 22 can automatically bounce back and cover the flange abutting part 232 and the gasket 223 can cover the plug holes 211 of the socket body 21 as well in order to prevent external water or other conductive liquid from entering thereby eliminating possible electric shock or leakage consequences.

Figure 5:
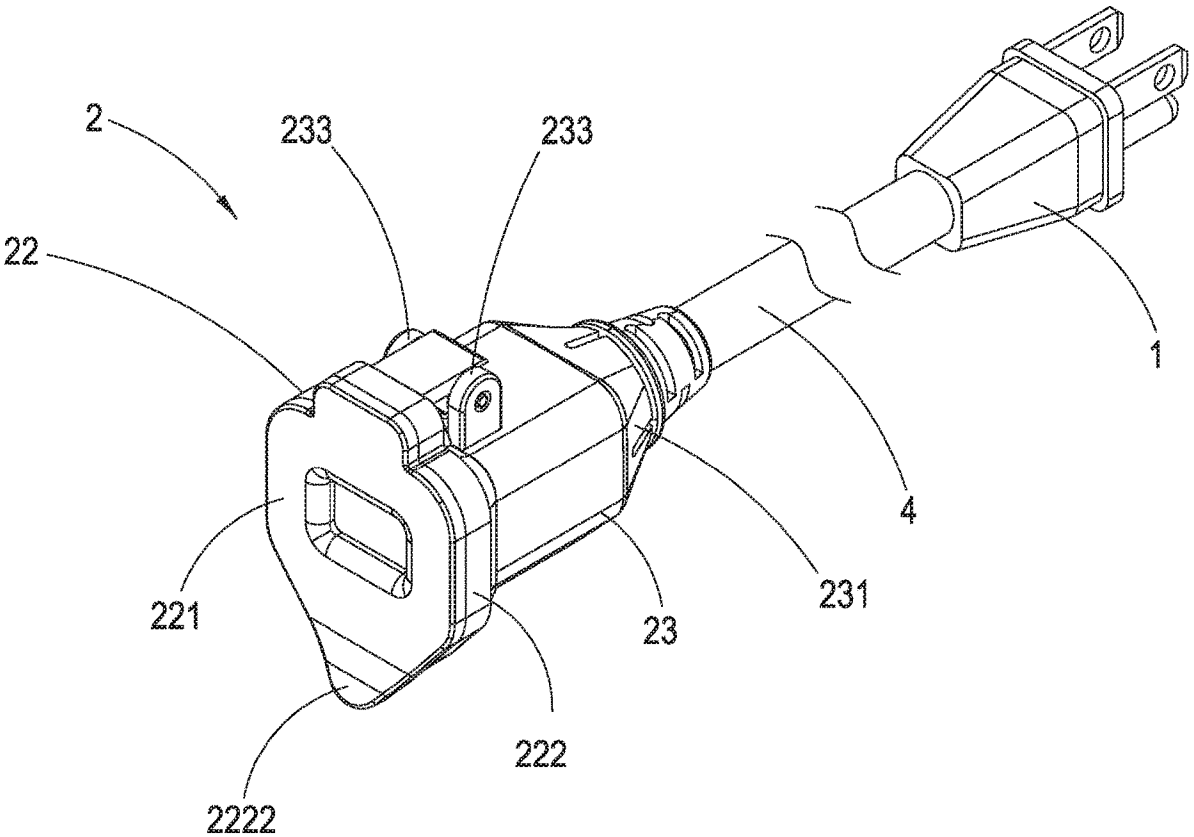
FIG. 5 shows a structural view of the lid-equipped power socket structure in integral combination, according to the present invention.
Figure 7:
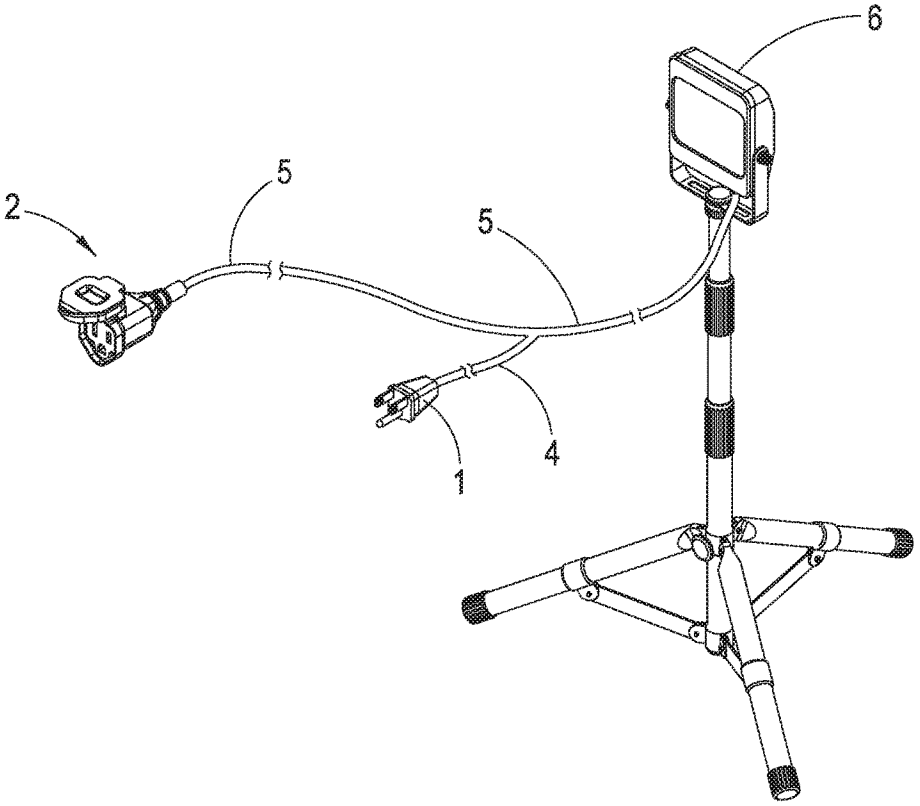
FIG. 7 shows another implementation structural view of the lid-equipped power socket structure according to the present invention.

Moreover, the set of power line materials in the present invention may include a single line material or else a pair of line materials, as explained hereunder:

1. as shown in FIG. 5, the aforementioned set of power line materials includes a first power line material 4, in which an end of the first power line material 4 is electrically connected to the electric power socket 2 while the other end of the first power line material 4 is electrically connected to the electric power plug 1, such that electric power coming from the electric power plug 1 can be provided to the electric power socket 2;

2. as shown in FIG. 7, the set of power line materials includes a first power line material 4 as well as two extension power line materials 5 extending from the first power line material 4, in which an end of the first power line material 4 is electrically connected to the electric power plug 1 and an end of the at least one extension power line material 5 is electrically connected to at least one electric power socket 2, while the other end of the at least one extension power line material 5 is electrically connected to at least one electronic device 6, such that electric power coming from the electric power plug 1 can be shunted to the at least one electric power socket 5 and at least one electronic device 6, also in which the electronic device 6 may be a lamp.

In comparison with other conventional technologies, the lid-equipped power socket structure according to the present invention provides the following advantages:

1. The present invention can completely cover the plug holes of the socket by using a liftable lid body so as to prevent the plug holes from contacting conductive liquid thus reducing the possibility of electric power leakage or shock problems due to water.

2. It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A lid-equipped power socket structure, comprising:

at least one or more electric power sockets, wherein the electric power socket includes:

a socket body, having three plug holes thereon;

a lid body, including a top lid part, in which an outer frame flange extends upwards from the perimeter of the top lid part, and a closed lid space can be formed between the top lid part and the outer frame flange, and the interior of the top lid part protrudes towards the closed lid space and is installed with a gasket thereon, which extends from an end of the outer frame flange to form a connecting part;

an external cladding shell, capable of being sleeve installed onto the external surface of the socket body, in which the external cladding shell is a hollow accommodating shell, with an end of the hollow accommodating shell including a flexible convergent opening so that the hollow accommodating shell can be sleeve installed onto the external surface of the socket body and then further sleeve tied onto the socket body by means of the flexible convergent opening; meanwhile, the other end of the hollow accommodating shell includes an outwardly protrusive flange abutting part, and a lug part conjunctively having a torsion spring and a pivotal axle is installed in the proximity of the flange abutting part, in which the connecting part of the lid body is pivotally connected to the lug part via the torsion spring and the pivotal axle such that the outer frame flange of the lid body can cover the flange abutting part and the gasket within the closed lid space can abut against the plug holes of the socket body; and an electric power plug, electrically connected to the electric power socket through a set of power line materials.

2. The lid-equipped power socket structure according to claim 1, wherein a flange is configured on the upper side of the socket body.

3. The lid-equipped power socket structure according to claim 1, wherein the set of power line materials includes a first power line material, and an end of the first power line material is electrically connected to the electric power socket while the other end of the first power line material is electrically connected to the electric power plug, such that electric power coming from the electric power plug can be provided to the electric power socket.

4. The lid-equipped power socket structure according to claim 1, wherein the set of power line materials includes a first power line material as well as several extension power line materials extending from the first power line material, in which an end of the first power line material is electrically connected to the electric power plug and an end of the at least one extension power line material is electrically connected to at least one electric power socket, while the other end of the at least one extension power line material is electrically connected to at least one electronic device, such that electric power coming from the electric power plug can be shunted to the at least one electric power socket and at least one electronic device.

5. The lid-equipped power socket structure according to claim 4, wherein the electronic device may be a lamp.

6. The lid-equipped power socket structure according to claim 1, wherein a liftable plate may further extend from the other end of the outer frame flange in the lid body, with the liftable plate and top lid part being mutually tilted at a certain angle.

7. The lid-equipped power socket structure according to claim 1, wherein the inside of the top lid part in the lid body includes an inner frame part, with the gasket being combined within the inner frame part.

* * * * *